United States Patent [19]

Sugimoto et al.

[11] Patent Number: 4,609,621

[45] Date of Patent: Sep. 2, 1986

[54] SILVER HALIDE PHOTOGRAPHIC LIGHT-SENSITIVE MATERIAL

[75] Inventors: Tadao Sugimoto; Sumito Yamada; Tadashi Ikeda; Haruo Takei; Masaki Okazaki, all of Kanagawa, Japan

[73] Assignee: Fuji Photo Film Co., Ltd., Kanagawa, Japan

[21] Appl. No.: 714,415

[22] Filed: Mar. 20, 1985

Related U.S. Application Data

[63] Continuation-in-part of Ser. No. 536,044, Sep. 26, 1983, abandoned.

[30] Foreign Application Priority Data

Sep. 24, 1982 [JP] Japan ..... 57/166321

[51] Int. Cl.[4] ..... E03C 1/02; E03C 1/16; E03C 1/12

[52] U.S. Cl. ..... 430/567; 430/583; 430/591; 430/543; 430/966

[58] Field of Search ..... 430/567, 583, 591, 543, 430/966

[56] References Cited

U.S. PATENT DOCUMENTS

| | | | |
|---|---|---|---|
| 4,425,425 | 1/1984 | Abbott et al. | 430/502 |
| 4,425,426 | 1/1984 | Abbott et al. | 430/502 |
| 4,439,520 | 3/1984 | Kotron et al. | 430/434 |

*Primary Examiner*—Mary F. Downey
*Attorney, Agent, or Firm*—Sughrue, Mion, Zinn, Macpeak and Seas

[57] ABSTRACT

A silver halide photographic light-sensitive material is disclosed. The material is comprised of a support base having provided thereon a hydrophilic colloid layer and a silver halide emulsion layer. The silver halide emulsion layer contains tubular silver halide grains having a diameter at least 3 times their thickness and also contains a compound represented by general formula (I) or (II):

(I)

(II)

the substituents are defined within the specification. The material obtains the advantages of utilizing tabular silver halide grains while having a reduced dependents of its photographic properties on development processing conditions which normally effect materials containing tabular silver halide grains.

32 Claims, No Drawings

SILVER HALIDE PHOTOGRAPHIC LIGHT-SENSITIVE MATERIAL

FIELD OF THE INVENTION

This invention relates to a silver halide photographic light-sensitive material and, more particularly, to a silver halide photographic light-sensitive material containing tabular silver halide grains.

BACKGROUND OF THE INVENTION

In the field of silver halide photographic light-sensitive materials, various techniques have heretofore been considered to improve covering power of silver halide in view of saving silver. As one of the techniques, it is known to use tabular silver halide grains.

This technique of using tabular silver halide grains is excellent with respect to improving covering power. However, light-sensitive materials using tabular silver halide grains are susceptible to changes in development processing conditions. Therefore, the results obtained with the use of such grains is still not completely satisfactory.

It has been known to incorporate various additives, such as stabilizers and antifoggants, in ordinary silver halide photographic light-sensitive materials for the purpose of improving their dependence on development processing conditions. For example, nitrobenzimidazoles, mercaptothiazoles, benzotriazoles, nitrobenzotriazoles, mercaptotetrazoles, etc. are described as such additives in U.S. Pat. Nos. 3,954,474 and 3,982,947, Japanese Patent Publication No. 28660/77, etc. However, these additives cannot depress fluctuation of gradation of a silver halide photographic light-sensitive material containing tabular grains which can be caused by change in $Br^{\ominus}$ ion concentration of a developing solution or by high-temperature processing. However, these additives can depress an increase in fog of the light-sensitive material when processed in high-temperature processing.

For example, high-temperature development for efficiently conducting development, particularly, high-temperature, accelerated development processing using an automatic developing machine, is known and applied to processing of various light-sensitive materials with good results. However, since light-sensitive materials are to be processed at elevated temperatures in this type development processing, photographic emulsion films must be prevented from becoming physically fragile during the processing due to pressure applied thereto by rollers and belts of the automatic developing machine. Therefore, techniques must be worked out to enhance the physical strength of emulsion films with during their development in a developing solution to thereby maintain their physical strength. For this purpose, there is a technique of conducting processing with an aldehyde hardener to a developing solution. This technique serves to shorten the whole processing time due to the high-temperature processing, and the purpose of accelerating the processing can be attained to some extent. However, development processing with a developing solution containing, for example, an aldehyde, particularly an aliphatic dialdehyde, concurrently causes serious fog. This tendency becomes more serious as the temperature of the developing solution becomes higher and as the processing time becomes longer. The fog to be caused with such aldehydes can be depressed to some extent by using strong antifogging agents such as benzotriazole and 1-phenyl-5-mercaptotetrazole (described in *PHOTOGRAPHIC PROCESSING CHEMISTRY* written by L. F. A. Mason, p. 40). However, these antifogging agents concurrently have a strong effect on depressing development, thus emulsion sensitivity is seriously reduced. In spite of the addition of such strong antifogging agents, liquid compositions of a developing solution still undergo considerable change in the high-temperature, accelerated processing (for example, at 28° to 38° C. for 25 seconds) by air oxidation of the developing solution and by change of processed light-sensitive materials, resulting in serious fluctuation of photographic properties.

In addition, alkylene oxides, which can improve the dependence of the photographic properties on development processing conditions, cannot be added to ordinary silver halide photographic emulsions because they seriously decrease sensitivity.

SUMMARY OF THE INVENTION

It is, therefore, an object of the present invention to provide a silver halide photographic light-sensitive material containing tabular silver halide grains which is improved with respect to the dependence of photographic properties on development processing conditions.

Further object of the present invention is to provide a silver halide photographic light-sensitive material containing tabular silver halide grains which is improved with respect to the stain of the photographic light-sensitive material after being developed.

Still further object of the present invention is to provide a silver halide X-ray photographic material containing tabular silver halide grains which is improved with respect to the dependence of sensitivity on a fluorescent screen (i.e., the change of sensitivity of the X-ray photographic material depending on the emission wavelength of the fluorescent screen is reduced).

As a result of various investigations, the inventors have found that the above-described object can be effectively attained by the following silver halide photographic light-sensitive material; that is, a silver halide photographic light-sensitive material having a support, a hydrophilic colloid layer or layers, and a silver halide emulsion layer or layers, wherein at least one of the silver halide emulsion layers contains tabular silver halide grains having a diameter at least 3 times their thickness and a compound represented by the following general formula (I) or (II):

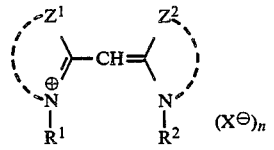

(I)

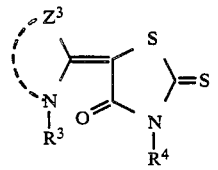

(II)

wherein $Z^1$ represents atoms necessary to complete an oxazole, a benzoxazole or a naphthoxazole, $Z^2$ represents atoms necessary to complete an oxazole, a benzoxazole, a naphthoxazole, a thiazole, a benzothiazole or a naphthothiazole, $Z^3$ represents atoms necessary to complete an oxazole, a benzoxazole or a naphthoxazole, $R^1$, $R^2$, and $R^3$ each represents an alkyl group or a substituted alkyl group, $R^4$ represents an alkyl group, a substituted alkyl group, an aryl group or a substituted aryl group, X represents an acid anion, n represents 0 or 1, and the compound represented by the general formula (II) contains at least one organic acid-subsituted alkyl group.

DETAILED DESCRIPTION OF THE INVENTION

Examples of the hetero ring nucleus completed by $Z^1$ in the above general formula (I) include oxazoles (e.g., oxazole, 4-methyloxazole, 4,5-dimethyloxazole, etc.), benzoxazoles (e.g., benzoxazole, 5-chlorobenzoxazole, 5-methylbenzoxazole, 5-methoxybenzoxazole, 5-phenylbenzoxazole, 5,6-dimethylbenzoxazole, etc.), naphthoxazoles (e.g., naphtho[1,2-d]oxazole, naphtho[2,1-d]oxazole, naphtho[2,3-d]oxazole, etc.), and the like.

Examples of the hetero ring nucleus completed by $Z^2$ in the above general formula (I) include oxazoles (e.g., oxazole, 4-methyloxazole, 4,5-dimethyloxazole, etc.), benzoxazoles (e.g., benzoxazole, 5-chlorobenzoxazole, 5-methylbenzoxazole, 5-methoxybenzoxazole, 5-phenylbenzoxazole, 5,6-dimethylbenzoxazole, etc.), naphthoxazoles (e.g., naphtho[1,2-d]oxazole, naphtho[2,1-d]oxazole, naphtho[2,3-d]oxazole, etc.), thiazoles (e.g., thiazole, 4-methylthiazole, 4,5-dimethylthiazole, etc.), benzothiazoles (e.g., benzothiazole, 5-chlorobenzothiazole, 5-methylbenzothiazole, 6-methylbenzothiazole, 5-bromobenzothiazole, 5-phenylbenzothiazole, 5-methoxybenzothiazole, 6-methoxybenzothiazole, 5-hydroxybenzothiazole, 6-hydroxybenzothiazole, 5-ethoxy-6-methylbenzothiazole, 5-hydroxy-6-methylbenzothiazole, 5,6-dimethylbenzothiazole, 5-chloro-6-methylbenzothiazole, etc.), naphthothiazoles (e.g., naphtho[1,2-d]thiazole, naphtho[2,1-d]thiazole, naphtho[2,3-d]thiazole, etc.), and the like.

Examples of the alkyl group represented by $R^1$ and $R^2$ in the general formula (I) include a methyl group, an ethyl group, a n-propyl group, a n-butyl group, etc. Examples of the substituted alkyl group represented by $R^1$ and $R^2$ include a hydroxyalkyl group (e.g., a 2-hydroxyethyl group, a 3-hydroxypropyl group, a 4-hydroxybutyl group, etc.), an acetoxyalkyl group (e.g., a β-acetoxyethyl group, a γ-acetoxypropyl group, etc , an alkoxyalkyl group (e.g., a β-methoxyethyl group, a γ-methoxypropyl group, etc.), an alkoxycarbonylalkyl group (e.g., a β-methoxycarbonylethyl group, a β-ethoxycarbonylethyl group, a γ-methoxycarbonylpropyl group, a δ-ethoxycarbonylbutyl group, etc.), a carboxyalkyl group (e.g., a carboxymethyl group, a β-carboxyethyl group, a γ-carboxypropyl group, a δcarboxybutyl group, etc.), a sulfoalkyl group (e.g., a β-sulfoethyl group, a γ-sulfopropyl group, a γ-sulfobutyl group, a δ-sulfobutyl group, a 2-(3-sulfopropoxy)ethyl group, a 2-[2-(3-sulfopropoxy)ethoxy]ethyl group, etc.), an allyl group (i.e., a vinylmethyl group), a cyanoalkyl group (e.g., a β-cyanoethyl group, etc.), a carbamoylalkyl group (e.g., a β-carbamoylethyl group, a γ-carbamoylpropyl group, etc.), an aralkyl group (e.g., a benzyl group, a 2-phenylethyl group, a 2-(4-sulfophenyl)ethyl group, etc.), and the like. As the alkyl group, those which contain 1 to 8 carbon atoms are preferable and, as the substituted alkyl group, those which contain 1 to 10 carbon atoms are preferable.

As the hereto ring nucleus completed by $Z^3$ in the foregoing general formula (II), there are illustrated those which are the same as are illustrated with respect to $Z^1$ in the general formula (I).

Examples of $R^3$ are also the same as are illustrated with respect to $R^1$ and $R^2$ in the general formula (I).

Examples of the alkyl group represented by $R^4$ in the general formula (II) include a methyl group, an ethyl group, a n-propyl group, a n-butyl group, etc. Examples of the substituted alkyl group represented by $R^4$ include a sulfoalkyl group (e.g., a 2-sulfoethyl group, a 3-sulfopropyl group, a 3-sulfobutyl group, a 4-sulfobutyl group, etc.), a carboxyalkyl group (e.g., a 2-carboxyethyl group, a 3-carboxypropyl group, a 4-carboxybutyl group, a carboxymethyl group, etc.), a hydroxyalkyl group (e.g., a 2-hydroxyethyl group, a 3-hydroxypropyl group, a 4-hydroxybutyl group, etc.), an alkoxyalkyl group (e.g., a 2-methoxyethyl group, a 3-methoxypropyl group, etc.), an acyloxyalkyl group (preferably acetoxyalkyl group, e.g., a 2-acetoxyethyl group, etc.), an alkoxycarbonylalkyl group (e.g., a methoxycarbonylmethyl group, an ethoxycarbonylmethyl group, a 2-methoxycarbonylethyl group, a 4-ethoxycarbonylbutyl group, etc.), a substituted alkoxyalkyl group (e.g., a hydroxymethoxymethyl group, a 2-hydroxyethoxymethyl group, a 2-(2-hydroxyethoxy)ethyl group, a 2-(2-acetoxyethoxy)ethyl group, an acetoxymethoxymethyl group, a methoxyethoxyethyl group, etc.), a dialkylaminoalkyl group (e.g., a 2-dimethylaminoethyl group, a 2-diethylaminoethyl group, a 2-piperidinoethyl group, a 2-morpholinoethyl group, etc.), an N-(N,N-dialkylaminoalkyl)carbamoylalkyl group (e.g., an N-[3-(N,N-dimethylamino)propyl]carbamoylmethyl group, an N-[2-(N,N-diethylamino)ethyl]carbamoylmethyl group, an N-[3-(morpholino)propyl]carbamoylmethyl group, an N-[3-(piperidino)propyl]carbamoylmethyl group, etc.), an N-(N,N,N-trialkylammonioalkyl)carbamoylalkyl group (e.g., an N-[3-(N,N,N-trimethylammonio)propyl]carbamoylmethyl group, an N-[3-(N,N,N-triethylammonio)propyl]carbamoylmethyl group, an N-[3-(N-methylpiperidinio)propyl]carbamoylmethyl group, etc.), an N,N,N-trialkylammonioalkyl group (e.g., an N,N-diethyl-N-methylammonioethyl group, an N,N,N-triethylammonioethyl group, etc.), a cyanoalkyl group (e.g., a 2-cyanoethyl group, a 3-cyanopropyl group, etc.), a carbamoylalkyl group (e.g., a 2-carbamoylethyl group, a 3-carbamoylpropyl group, etc.), a hetero ring-substituted alkyl group (e.g., a tetrahydrofurfuryl group, a furfuryl group, etc.), an allyl group (i.e., a vinylmethyl group), an aralkyl group (e.g., a benzyl group, a 2-phenylethyl group, etc.), and the like. Examples of the aryl group and the substituted aryl group represented by $R^4$ include an aryl group (e.g., a phenyl group, etc.), and a substituted aryl group (e.g., p-chlorophenyl group, a p-tolyl group, a p-methoxyphenyl group, a p-carboxyphenyl group, a m-carboxyphenyl group, a p-methoxycarbonylphenyl group, a m-acetylaminophenyl group, a p-acetylaminophenyl group, a m-dialkylaminophenyl group (e.g., a m-dimethylaminophenyl group), a p-dialkylaminophenyl group (e.g., a p-dimethylaminophenyl group), etc.), and the like. As the alkyl group, those which contain 1 to 8 carbon atoms are preferable and, as the substituted alkyl group, those which contain 1 to 10 carbon atoms are preferable. Preferable examples of the substituted alkyl group include a hydroxyalkyl group, an acetoxyalkyl group, an alkoxyalkyl group, a substituted alkoxyalkyl group, an alkoxycarbonylalkyl group, a carboxyalkyl group, a sulfoalkyl group, an allyl group, a carbamoylalkyl group, an N-(N,N-dialkylaminoalkyl)carbamoylalkyl group, an N-(N,N,N-trialkylammonioalkyl)carbamoylalkyl group, an aralkyl group, a hetero ring-substituted alkyl group. As the aryl group and the substituted aryl groups, those which contain 6 to 10 carbon atoms are preferable.

The compound represented by the general formula (II) contain at least one alkyl group substituted with an organic acid group (for example, a carboxy group, a sulfo group, etc.).

Examples of the acid anion represented by X include an iodine ion, a p-toluene sulfonate ion, a methylsulfate ion, a bromine ion, and the like.

Among the compounds represented by the general formula (I), these wherein $Z^1$ represents atoms necessary to complete a benzoxazole and $Z^2$ represents atoms necessary to complete a benzoxazole or a benzothiazole are preferable. In such case, more preferred benzoxazole and the benzothiazole completed by $Z^1$ or $Z^2$ are those substituted with a phenyl group or a chlorine atom, particularly preferably substituted with a phenyl group. $R_1$ or/and $R_2$ are preferably an alkyl group substituted with an organic acid group (for example, a carboxy group, a sulfo group, etc.). Particularly preferably both $R_1$ and $R_2$ are an alkyl group substituted with an organic acid group.

Among the compounds represented by the general formula (II), $R_3$ or/and $R_4$ are preferably an alkyl group substituted with the organic acid group. $Z^3$ preferably represents atoms necessary to complete a benzoxazole, more preferably a benzoxazole substituted with a phenyl group or a chlorine atom, and most preferably a benzoxazole substituted with a phenyl group.

Typical specific examples of the compounds represented by the general formula (I) and (II) are illustrated below.

Compound I-1

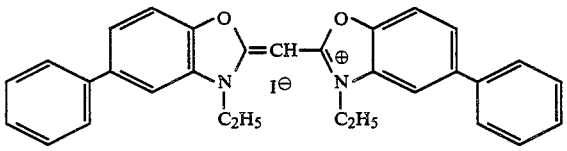

Compound I-2

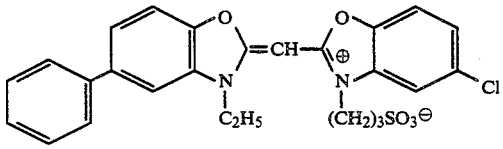

Compound I-3

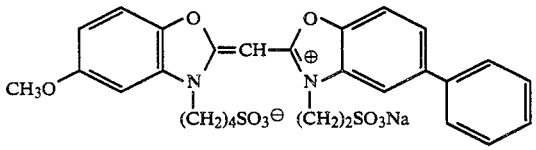

-continued

Compound I-4

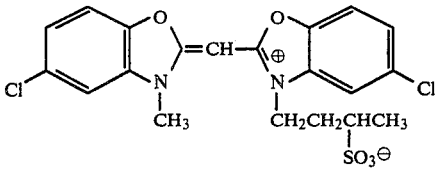

Compound I-5

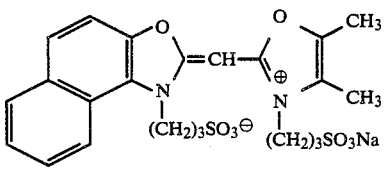

Compound I-6

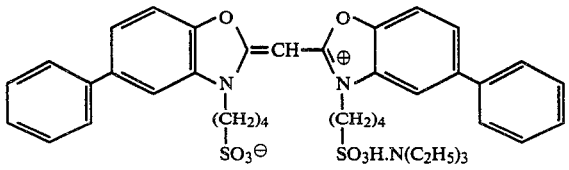

Compound I-7

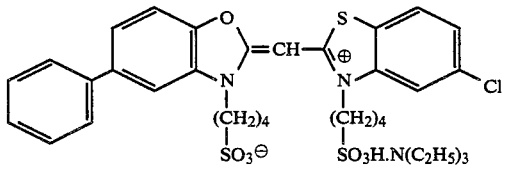

Compound I-8

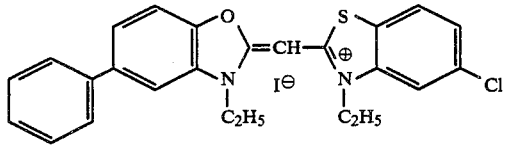

Compound I-9

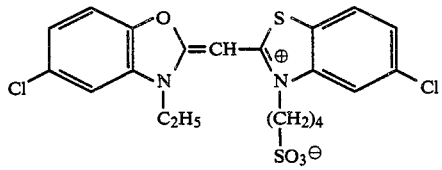

Compound I-10

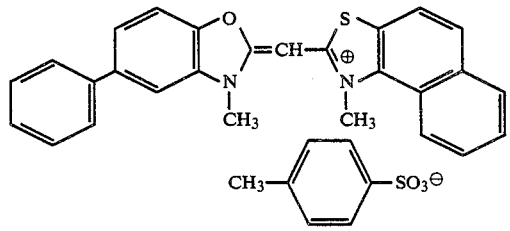

-continued
Compound I-11
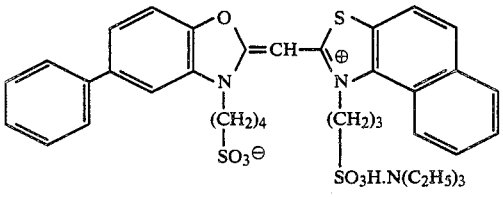
Compound I-12
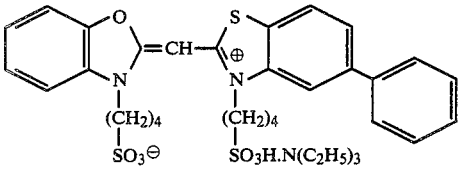
Compound I-13
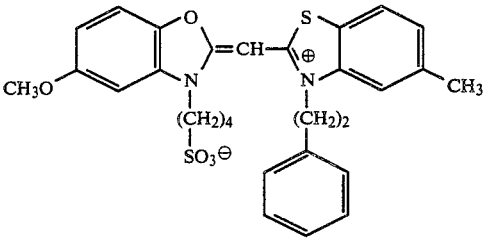
Compound I-14
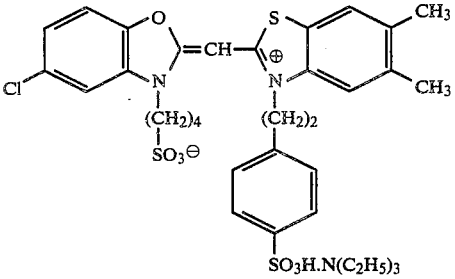
Compound I-15
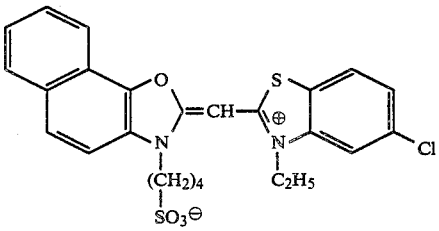
Compound I-16
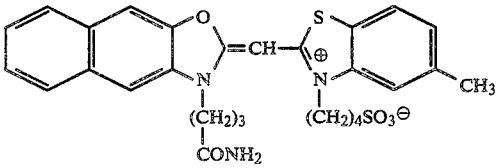
Compound I-17
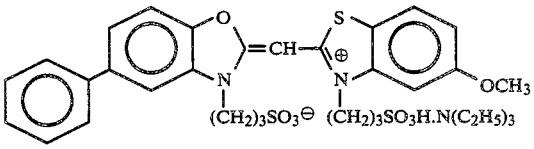
-continued
Compound I-18
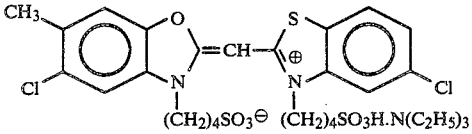
Compound II-1
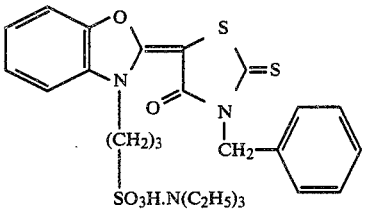
Compound II-2
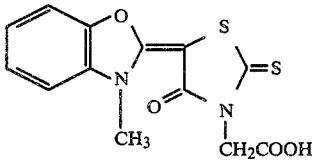
Compound II-3
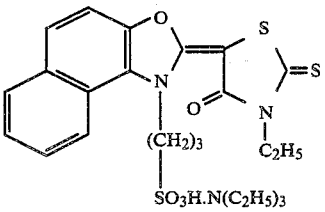
Compound II-4
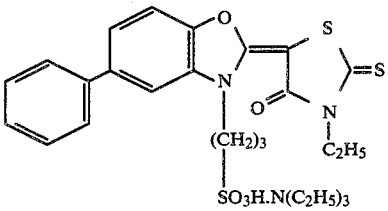
Compound II-5
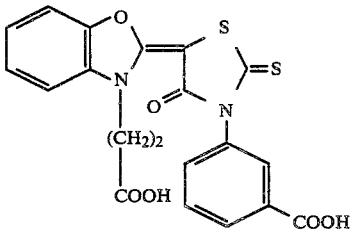
Compound II-6
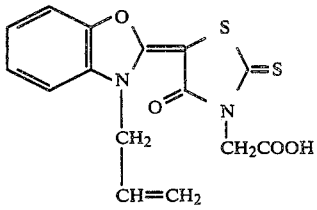

-continued

Compound II-7

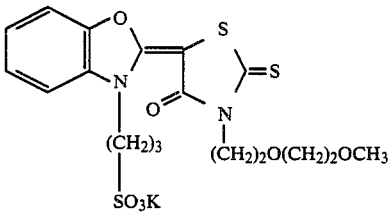

Compound II-8

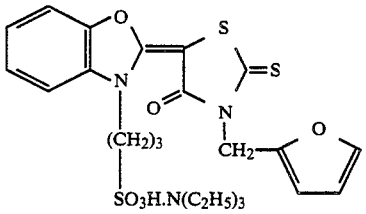

Compound II-9

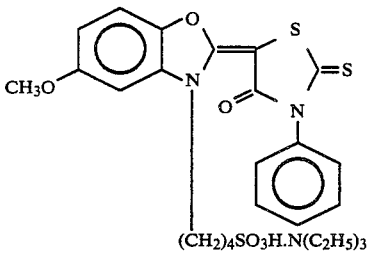

Compound II-10

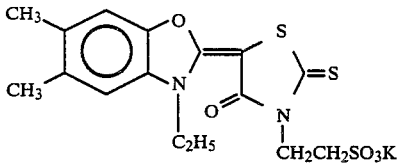

Compound II-11

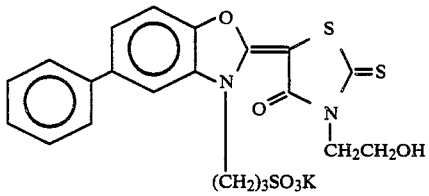

The compounds represented by the general formulae (I) and (II) are known and easily available, or may be easily synthesized according to the descriptions given in the following literatures: F. M. Hamer, *The chemistry of heterocyclic compounds; The cyanine dyes and related compounds,* p. 58 and p. 536 (John Wiley & Sons (New York, London, 1964).

To the silver halide emulsion layer containing the tabular grains are added the compounds represented by the general formula (I) or (II) alone or in combination.

The compounds represented by the general formula (I) or (II) are added in amounts of 0.01 to 10 m mols, preferably 0.05 to 1.0 m mol, per mol of silver halide in the tabular grains-containing silver halide emulsion layer. The compound may be added to the emulsion layer by any generally known method. The compounds may be added thereto in any stage in the process of manufacturing silver halide photographic light-sensitive materials; for example, during production of a silver halide emulsion (e.g., during or after postripening) or immediately before coating the emulsion.

Tabular silver halide grains to be used in the present invention will be described below.

Tabular silver halide grains of the present invention have a diameter-to-thickness ratio of 3 or more, preferably 5 or more, more preferably 5 to 50, particularly preferably 7 to 20.

By the term "diameter of silver grains" is meant a diameter of a circle having an equal area to the projected area of the grain. In the present invention, the diameters of the tabular silver halide grains range from 0.5 to 5.0μ, preferably from 1.0 to 4.0μ.

In general, tabular silver halide grains are in a tabular form having two parallel planes. Therefore, in the present invention "thickness" of grain is presented as a distance between the two parallel planes constituting the tabular silver halide grain.

As to silver halide composition of the tabular silver halide grains, silver bromide and silver bromoiodide are preferable, with silver bromoiodide containing 0 to 10 mol % silver iodide being particularly preferable.

Processes for preparing the tabular silver halide grains are described below.

The tabular silver halide grains can be prepared by properly combining processes known to those skilled in the art; for example, by forming seed crystals containing 40% by weight or more tabular grains in an environment of a comparatively high pAg value of, for example, not more than 1.3 in pBr, then simultaneously adding thereto a silver salt solution and a halide solution with keeping the pBr at about the same level to thereby allow the seed crystals to grow.

In the course of the growth of the grains, addition of the silver salt solution and the halide solution are desirable so as not to form new crystal nuclei.

The size of tabular silver halide grain can be properly adjusted by adjusting temperature, selecting the proper kind and amount of solvent, and controlling the speed of adding the silver salt and the halide upon growth of the grains.

In production of the tabular silver halide grains of the present invention, a silver halide solvent may be used, if desired, for controlling grain size, form of grain (e.g., diameter-to-thickness ratio), particle size distribution of the grains, and the grains-growing rate. Such solvent is used in an amount of $10^{3-3}$ to 1.0 wt %, particularly $10^{-2}$ to $10^{-1}$ wt %, based on the reaction solution.

For example, particle size distribution can be made monodispersed and the grain growth rate can be accelerated by increasing the amount of the solvent used. On the other hand, the use of an increased amount of the solvent tends to increase the thickness of the resulting grains.

Silver halide solvents often used include ammonia, thioethers, thioureas, etc. As to thioethers, reference can be made to U.S. Pat. Nos. 3,271,157, 3,790,387, 3,574,628, etc.

Upon production of the tabular silver halide grains of the present invention, the silver salt solution (for example, a silver nitrate aqueous solution) and the halide solution (for example, a potassium bromide aqueous solution) are added preferably in such manner that the adding rate, added amounts and added concentration are increased for accelerating the particle growth.

As to the process for producing silver halide grains, reference can be made to British Pat. No. 1,335,925, U.S. Pat. Nos. 3,672,900, 3,650,757 and 4,242,445, and Japanese Patent Application (OPI) Nos. 142329/80 and 158124/80, etc.

The tabular silver halide grains of the present invention can be chemically sensitized as the occasion demands.

As the chemically sensitizing methods, gold sensitization using a so-called gold compound (e.g., U.S. Pat. Nos. 2,448,060 and 3,320,069, etc.), metal sensitization using iridium, platinum, rhodium, palladium, etc. (e.g., U.S. Pat. Nos. 2,448,060, 2,566,245 and 2,566,263, etc.), sulfur sensitization using a sulfur-containing compound (e.g., U.S. Pat. No. 2,222,264, etc.), and reduction sensitization using a tin salt or a polyamine (e.g., U.S. Pat. Nos. 2,487,850, 2,518,698 and 2,521,925, etc.) can be employed alone or in a combination of two or more of them.

With respect to saving silver, the tabular silver halide grains of the present invention are preferably subjected to gold sensitization, sulfur sensitization or a combination thereof.

A layer containing the tabular silver halide grains of the present invention preferably contains 40% by weight or more, particularly preferably 60% by weight or more, of the tabular grains based on the whole silver halide grains.

The layer containing the tabular silver halide grains preferably has a thickness of 0.3 to 5.0μ, particularly preferably 0.5 to 3.0μ.

The tabular silver halide grains are preferably coated in an amount of 0.5 to 6 g/m$^2$, particularly preferably 1 to 4 g/m$^2$ (per one side of a support).

Other constituents of the layer containing the tabular silver halide grains of the present invention, such as a binder, a hardener, an antifoggant, a silver halide-stabilizing agent, a surfactant, an optically sensitizing agent, a dye, an ultraviolet ray absorbent, a chemically sensitizing agent, etc. are not particularly limited, and reference can be made to, for example, *Research Disclosure,* vol. 176, pp. 22 to 28 (Dec., 1978).

Ordinary silver halide grains may be incorporated in the emulsion layer of the silver halide light-sensitive material of the present invention in addition to the tabular silver halide grains. Such grains can be prepared by processed described in P. Grafkides, *Chimie et Physique Photographique,* (published by Paul Montel in 1967); G. F. Duffin, *Photographic Emulsion Chemistry,* (The Focal Press, 1966); and V. L. Zelikman et al, *Making and Coating Photographic Emulsion,* (The Focal Press, 1964), that is, by any of an acidic process, a neutral process, an ammoniacal process, etc. As to the manner of reacting a soluble silver salt with a soluble halide salt, any of one side mixing, simultaneous mixing, and their combination may be employed.

A process of forming grains in the presence of excess silver ion (called reverse mixing process) can be employed as well. As one type of the simultaneous mixing, a process called controlled double jet process wherein pAg in a liquid phase in which silver halide is formed is kept constant can be employed.

As silver halide, any of silver bromide, silver bromoiodide, silver chlorobromoiodide, silver chlorobromide, and silver chloride may be used.

During formation or physical ripening of silver halide grains, cadmium salts, zinc salts, lead salts, thallium salts, iridium salts or the complex salts thereof, rhodium salts or the complex salts thereof, iron salts or the complex salts thereof, etc. may be allowed to coexist. If desired, the grains may be chemically sensitized in the same manner as with the tabular silver halide grains.

Various compounds may be incorporated in the photographic emulsion to be used in the present invention for preventing fogging of light-sensitive materials during their production, storage or photographic processing or for stabilizing photographic properties of the materials. That is, known antifoggants or stabilizers can be added, for example, azoles (e.g., benzothiazolium salts, nitroindazoles, nitrobenzimidazoles, chlorobenzimidazoles, bromobenzimidazoles, mercaptothiazoles, mercaptobenzothiazoles, mercaptobenzimidazoles, mercaptothiadiazoles, aminotriazoles, benzotriazoles, nitrobenzotriazoles, mercaptotetrazoles (particularly, 1-phenyl-5-mercaptotetrazole), etc.); mercaptopyrimidines; mercaptotriazines; thioketo compounds such as oxazolinethione; azaindenes (e.g., triazaindenes, tetrazaindenes (particularly, 4-hydroxy-substituted (1,3,3a,7)tetrazaindenes), pentazaindenes, etc.); benzenethiosulfonic acid; benzenesulfinic acid; benzenesulfonic acid amide; etc. For example, those described in U.S. Pat. Nos. 3,954,474, and 3,982,947, and Japanese Patent Publication No. 28660/77 can be used.

The photographic emulsion to be used in the present invention may be spectrally sensitized with methine dyes or the like.

Useful sensitizing dyes are those described in, for example, German Pat. No. 929,080, U.S. Pat. Nos. 2,493,748, 2,503,776, 2,519,001, 2,912,329, 3,656,959, 3,672,897, 3,694,217, 4,025,349 and 4,046,572, British Pat. No. 1,242,588 and Japanese Patent Publication Nos. 14030/69 and 24844/77.

These sensitizing dyes may be used alone or in a combination. Combinations of sensitizing dyes are often employed particularly for the purpose of supersensitization. Typical examples thereof are described in U.S. Pat. Nos. 2,688,545, 2,977,229, 3,397,060, 3,522,052, 3,527,641, 3,617,293, 3,628,964, 3,666,480, 3,672,898, 3,679,428, 3,703,377, 3,814,609, 3,837,862 and 4,026,707, British Pat. Nos. 1,344,281 and 1,507,803, Japanese Patent Publication Nos. 4936/68, 12375/78 and Japanese Patent Application (OPI) Nos. 110618/77 and 109925/77.

A dye which itself does not have a spectrally sensitizing effect or a substance which substantially does not absorb visible light and which shows a supersensitizing effect may be incorporated together with the sensitizing dye. For example, aminostilbene compounds substituted by a nitrogen-containing hetero ring group (e.g., those described in U.S. Pat. Nos. 2,933,390 and 3,635,721), aromatic organic acid-formaldehyde condensates (for example, those described in U.S. Pat. No. 3,743,510), cadmium salts, azaindene compounds, etc. may be incorporated. Combinations described in U.S. Pat. Nos. 3,615,613, 3,615,641, 3,617,295, and 3,635,721 are particularly useful.

The photographic light-sensitive material of the present invention can contain in its photographic emulsion layer color-forming couplers capable of forming color by oxidative coupling with an aromatic primary amine developing agent (for example, a phenylenediamine derivative or an aminophenol derivative) in color development processing. For example, magenta couplers include 5-pyrazolone couplers, pyrazolobenzimidazole couplers, cyanoacetylcoumarone couplers, open-chain acylacetonitrile couplers, etc., yellow couplers include acylacetamide couplers (e.g., benzoylacetanilide couplers, pyvaloylacetanilide couplers, etc.), and cyan couplers include naphthol couplers and phenol couplers. Of these couplers, non-diffusible couplers having a hydrophobic group called ballast group are desirable. The couplers may be of either 4-equivalent type or 2-equivalent type with respect to silver ion. Colored couplers having color-correcting effect or couplers capable of releasing a development inhibitor upon development (called DIR couplers) may also be used.

In addition to DIR couplers, DIR coupling compounds capable of forming a colorless coupling reaction product and releasing a development inhibitor may also be incorporated.

Other constitutions of the emulsion layer of the silver halide photographic light-sensitive material in accordance with the present invention are not particularly limited, and various additives may be used as the occasion demands. For example, binders, surfactants, UV ray absorbents, hardeners, coating aids, thickening agents, etc. described in Research Disclosure, 176, pp. 22–28 (Dec. 1978) may be used.

The photographic material of the present invention preferably has on its surface a surface-protecting layer containing as a major component a synthetic or natural high polymer substance such as gelatin, water-soluble polyvinyl compound or acrylamide polymer (see, for example, U.S. Pat. Nos. 3,142,568, 3,193,386, and 3,062,674).

The surface-protecting layer may contain, in addition to gelatin or other high molecular substance, a surfactant, antistatic agent, a matting agent, a slipping agent, a hardener, a thickening agent, etc.

The photographic material of the present invention may also include an interlayer, a filter layer, an antihalation layer, etc.

The photographic emulsion layers and other layers of the photographic light-sensitive material of the present invention are coated on a flexible support such as plastic film, paper or cloth or on a rigid support such as glass, porcelain or metal, usually used for photographic light-sensitive materials. Useful flexible supports include films composed of semi-synthetic or synthetic high polymers such as cellulose nitrate, cellulose acetate, cellulose acetate butyrate, polystyrene, polyvinyl chloride, polyethylene terephthalate, polycarbonate, etc. and papers coated or laminated with a baryta layer or an $\alpha$-olefin polymer (for example, polyethylene, polypropylene, ethylene/butene copolymer, etc.). The support may be colored with a dye or a pigment, or may be blackened for intercepting light. The surface of the support is generally subbed for improving adhesion to a photographic emulsion layer or the like. The support surface may be subjected to corona discharge treatment, UV ray irradiation, or flame treatment before or after the subbing treatment.

In the present invention, processes for coating a tabular grains-containing layer, an emulsion layer, and a surface-protecting layer on a support are not particularly limited, and processes of simultaneously coating multilayers described in, for example, U.S. Pat. Nos. 2,761,418, 3,508,947, 2,761,791, etc. can be preferably used.

As to the stratum structure of the photographic material of the present invention, various structures are possible. For example, there are: (1) a stratum structure wherein a layer containing tabular silver halide grains in accordance with the present invention is provided on a support, a silver halide emulsion layer containing high speed silver halide grains of comparatively large particle size (0.5 to 3.0$\mu$) having a spherical form or having a diameter-to-thickness ratio of less than 3 is provided thereon, and a surface-protecting layer of gelatin or the like is further coated on the silver halide emulsion layer; (2) a stratum structure wherein a tabular silver halide grains-containing layer is provided on a support, a plurality of silver halide emulsion layers are provided thereon, and a surface-protecting gelatin layer is further provided thereon; (3) a stratum structure wherein one silver halide emulsion layer is provided on a support, a tubular silver halide grains-containing layer is provided thereon, a high-speed silver halide emulsion layer is provided thereon, and a surface-protecting gelatin layer on the high-speed silver halide emulsion layer; (4) a stratum structure wherein a layer containing an ultraviolet ray absorbent or a dye, a tabular silver halide grains-containing layer, a silver halide emulsion layer, and a surface-protecting gelatin layer are provided in this order on a support; and (5) a stratum structure wherein a layer containing tabular silver halide grains and an ultraviolet ray absorbent or a dye, a silver halide emulsion layer, and a surface-protecting gelatin layer are provided in this order on a support. In these embodiments, the silver halide emulsion layer is not necessarily a single layer and may be composed of a plurality of silver halide emulsion layers spectrally sensitized to different wavelength regions.

The silver halide photographic light-sensitive material of the present invention specifically includes color photographic light-sensitive materials such as color negative films, color reversal films, color papers, etc. as well as black-and-white photographic light-sensitive materials such as X-ray light-sensitive materials (for indirect X-ray or direct X-ray irradiation), lithographic light-sensitive materials, black-and-white photographic printing papers, black-and-white negative films, etc. X-ray light-sensitive materials which are to be subjected to high-temperature, accelerated development processing obtain the most remarkable effects.

In photographic processing of the light-sensitive materials of the present invention, any of known processes and known processing solutions described in, for example, *Research Disclosure,* No. 176, pages 28–30 may be employed. Such processing may be a black-and-white photographic processing for forming a silver image or a color photographic processing for forming a dye image depending upon the purpose. Processing temperature is usually selected between 18° to 50° C. However, temperatures lower than 18° C. or higher than 50° C. may be employed.

The developing solution for conducting black-and-white photographic processing can contain known developing agents. As the developing agents, dihydroxybenzenes (e.g., hydroquinone), 3-pyrazolidones (e.g., 1-phenyl-3-pyrazolidone), aminophenols (e.g., N-methyl-p-aminophenol), etc. can be used alone or in combination. Generally, the developing solution further contains known preservatives, alkali agents, pH buffers, antifogging agents, etc. and, if desired, may further contain dissolving aids, toning agents, development accelerators (e.g., quaternary salts, hydrazine, benzyl alcohol, etc.), surfactants, defoaming agents, water-softening agents, hardeners (e.g., glutaraldehyde), viscosity-imparting agents, etc.

So-called "lith-type" development processing may be applied to the photographic emulsion of the present invention. "Lith-type" development processing means a development processing of using usually a dihydroxybenzene as a developing agent and conducting development in an infectious manner at a low sulfite ion concentration for photographically reproducing line images or halftone dot images. (Detailed descriptions are given in Mason, *Photographic Processing Chemistry,* (1966), pp. 163–165.

As a special type development processing, a developing agent may be incorporated in a light-sensitive material, for example, in an emulsion layer, the resulting light-sensitive material being processed in an alkaline aqueous solution to develop. Of the developing agents, hydrophobic ones can be incorporated in an emulsion according to various techniques described in *Research Disclosure,* No. 169, U.S. Pat. No. 2,739,890, British Pat. No. 813,253 and West German Pat. No. 1,547,763, etc. Such development processing may be combined with a processing of stabilizing silver salt with a thiocyanate.

As a fixing solution, those which have the same formulation as are ordinarily employed can be used. As a fixing agent, organic sulfur compounds can be used as well as thiosulfates and thiocyanates. The fixing solution may contain an aqueous aluminum salt as a hardener.

In forming dye images, ordinary processes can be employed. For example, there may be employed a negative-positive process (described in, for example, *Journal of the Society of Motion Picture and Television Engineers,* vol. 61, pp. 667–701 (1953); a color reversal process of forming a negative silver image by developing with a developing solution containing, a black-and-white developing agent, conducting at least once uniform exposure or other proper fogging processing, and subsequently conducting color development to thereby obtain positive dye images; a silver dye-bleaching process of developing a silver image by developing a dye-containing photographic emulsion layer after imagewise exposure to thereby form a silver image, and bleaching the dye using the silver image as a bleaching catalyst.

A color developing solution generally comprises an alkaline aqueous solution containing a color-developing agent. As the color-developing agent, known primary aromatic amine developing agents such as phenylenediamines (e.g., 4-amino-N,N-diethylaniline, 3-methyl-4-amino-N,N-diethylaniline, 4-amino-N-ethyl-N-β-hydroxyethylaniline, 3-methyl-4-amino-N-ethyl-N-β-hydroxyethylaniline, 3-methyl-4-amino-N-ethyl-N-β-methanesulfamidoethylaniline, 4-amino-3-methyl-N-ethyl-N-β-methoxyethylaniline, etc.) can be used.

In addition, those described in L. F. A. Mason, *Photographic Processing Chemistry,* (Focal Press, 1966), pp. 226–229, U.S. Pat. Nos. 2,193,015 and 2,592,364 and Japanese Patent Application (OPI) No. 64933/73, etc. can be used.

To the color developing solution may further be added, if desired, a pH buffer, a development restrainer, an antifogging agent, a water softener, a preservative, an organic solvent, a development accelerating agent, an carboxylic acid type chelating agent, etc.

Specific examples of these additives are described in *Research Disclosure,* U.S. Pat. No. 4,083,723 and West German Patent Application (OLS) No. 2,622,950, etc.

The present invention remarkably reduces fluctuation in photographic properties caused by change in development processing conditions, without concurrent reduction in sensitivity, by adding a compound represented by the general formula (I) or (II) to a silver halide emulsion layer containing the aforementioned tabular silver halide grains. This effect is conspicous with high temperature, accelerated processing (for example, at 28° C. or above for 30 seconds or shorter). In particular, the present invention is effective for high-temperature, accelerated processing conducted by adding an aldehyde type hardener (glutaraldehyde or the like) to a developing solution.

The present invention will now be described in more detail by referring to following non-limiting examples of preferred embodiments of the present invention.

EXAMPLE 1

Photographic Material (1) was prepared as follows.

30 g of gelatin, 10.3 g of potassium bromide, and 10 cc of a 0.5 wt % thioether ($HO(CH_2)_2—S—(CH_2)_2—S—(CH_2)_2OH$) aqueous solution were added to 1 liter of water, and the resulting solution was kept in a vessel at 70° C. under stirring. To the vessel, solutions shown in Table 1 below were added with keeping pAg of 9.1 and pH of 6.5. That is, the following Solutions I and II were simultaneously added thereto in 15 seconds, followed by simultaneously adding thereto Solutions III and IV in 65 minutes according to a double jet method.

In addition, during the addition of the Solutions III and IV, Solution V was simultaneously added thereto in 15 minutes.

TABLE 1

| | Solution I | Solution II | Solution III | Solution IV | Solution V |
|---|---|---|---|---|---|
| $AgNO_3$ (g) | 4.5 | — | 95.5 | — | — |
| $H_2O$ (cc) | 17 | 16.7 | 561 | 542 | 100 |
| KBr (g) | — | 3.15 | — | 69.6 | — |
| KI (g) | — | — | — | — | 1.5 |
| 5 wt % aq. soln. of $HO(CH_2)_2S(CH_2)_2S(CH_2)_2OH$ (cc) | — | 0.45 | — | 15.0 | — |

The tabular silver halide grains thus obtained had a mean diameter of 2.3μ and an average diameter-to-thickness ratio of 10 and contained 1.5 mol % of AgI. Then, an antifogging agent (4-hydroxy-6-methyl-1,3,3a,7-tetrazaindene), a coating aid (dodecylbenzenesulfonate), and a thickening agent (polypotassium p-vinylbenzene-sulfonate) were added thereto to prepare a coating solution. This solution had a silver-to-gelatin ratio of 1.55 by weight.

Then, a 10 wt % gelatin aqueous solution containing gelatin, sodium polystyrenesulfonate, polymethyl methacrylate fine particles (mean particle size: 3.0μ), saponin, and 2,4-dichloro-6-hydroxy-s-triazine was prepared as a coating solution for forming a surface-protecting layer.

Next, on a polyethylene terephthalate film support were coated in sequence a silver halide emulsion layer composed of the above-described former coating solution and a surface-protecting layer composed of the above-described latter coating solution, then dried to prepare Photographic Material (1). In this occasion, the silver halide emulsion layer was coated in a silver amount of 2.8 g/m$^2$, and the surface-protecting layer in a gelatin amount of 1.3 g/m$^2$.

Photographic Materials (2) to (6) were prepared by adding Compounds I-6, I-7, and I-10 and Comparative Compounds a and b, respectively, to the coating solution used for preparing the above-described Photographic Material (1).

Each of the thus-prepared Photographic Materials (1) to (6) was exposed using Hi Standard screen (made by Fuji Photo Film Co., Ltd.; using calcium tungstate), then subjected to the following Processing A or B.

Processing A:

Developing the photographic material at 35° C. for 25 seconds with a color developing solution designed for X-ray automatic developing machines, Fuji RD-III (made by Fuji Photo Film Co., Ltd.), fixing it at 35° C. for 25 seconds with a fixing solution designed for X-ray automatic developing machines, Fuji F (made by Fuji Photo Film Co., Ltd.), then washing and drying it.

Processing B:

The same as the above-described processing A except for additionally adding 11.4 g/liter of KBr to the developing solution, RD-III.

The sensitivity of each of the thus-processed photographic materials was measured to obtain the results given in Table 2. In Table 2, sensitivity was presented as a logarithm of a reciprocal of an exposure amount necessary for attaining an effective density of 1.0 excluding fog.

TABLE 2

| Photographic Material | Compound Added | Amount Added (mmol/mol-Ag) | Sensitivity Difference based on (1) processed by Processing A (Δlog E) | Sensitivity Difference Between Processing A and Processing B/Sensitivity Difference Between Processing A and Processing B with (1) |
|---|---|---|---|---|
| (1) | none | — | 0 | 1.0 |
| (2) | Comparative Compound a | 0.2 | −0.10 | 0.98 |
| (3) | Comparative Compound b | 0.2 | −0.07 | 0.95 |
| (4) | Compound I-6 | 0.2 | −0.02 | 0.20 |
| (5) | Compound I-7 | 0.4 | +0.00 | 0.20 |
| (6) | Compound I-10 | 0.2 | −0.05 | 0.19 |

Comparative Compound a: 1-phenyl-5-mercaptotetrazole
Comparative Compound b: 5-nitrobenzotriazole As is clear from the results given in Table 2, addition of 1-phenyl-5-mercaptotetrazole or 5-nitrobenzotriazole, conventionally known as a stabilizing agent, scarcely served to reduce dependence of photographic sensitivity on KBr concentration of the processing solution, but addition of the compound of the present invention (Photographic Materials (4), (5), and (6)) served to remarkably reduce dependence of sensitivity on KBr concentration.

EXAMPLE 2

X-ray Photographic Material (11) was prepared as follows. Spherical grains (mean particle size: 1.35 μm) of silver bromoiodide (silver iodide: 1.5 mol %) were formed according to a double jet process in the presence of ammonia, then chemically sensitized with a chloroaurate and sodium thiosulfate. After completion of the chemical sensitization, anti-foggants of 1-phenyl-5-mercaptotetrazole and 4-hydroxy-6-methyl-1,3,3a,7-tetrazaindene, a coating aid of dodecylbenzenesulfonate, and a thickening agent of polypotassium p-vinylbenzene-sulfonate were added thereto to prepare a coating solution. This coating solution had a silver-to-gelatin weight ratio of 1.05.

A 10 wt % gelatin aqueous solution containing gelatin, sodium polystyrenesulfonate, polymethyl methacrylate fine particles (mean particle size: 3.0μ), saponin, and 2,4-dichloro-6-hydroxy-s-triazine was prepared as a solution for forming a surface-protecting layer.

Then, on a subbed, 180 μm thick polyethylene terephthalate film support were coated the silver halide emulsion layer composed of the above-described former coating solution and the surface-protecting layer composed of the above-described latter coating solution by a simultaneous extrusion coating technique, then dried to prepare Comparative Photographic Material (11). In this occasion, the silver halide emulsion layer was coated in a silver amount of 4.0 g/m$^2$, and the surface-protecting layer in a gelatin amount of 1.3 g/m$^2$ and in a thickness of 1.0μ.

Photographic Materials (12) to (16) were prepared in the same manner as with Photographic Material (11) except for additionally adding Compounds I-7, I-10, I-11, I-6 and II-1 shown in Table 2, respectively, to the silver halide emulsion of the Photographic Material (11).

X-ray Photographic Material (17) was prepared as follows.

30 g of gelatin, 10.3 g of potassium bromide, and 10 cc of a 0.5 wt % thioether ($HO(CH_2)_2—S—(CH_2)_2—S—(CH_2)_2OH$) aqueous solution were added to 1 liter of water, and the resulting solution was kept in a vessel at 70° C. under stirring. To the vessel, solutions shown in Table 3 below were added with keeping pAg of 9.1 and pH of 6.6. That is, the following Solutions I and II were simultaneously added thereto in 15 minutes, followed by simultaneously adding thereto Solutions III and IV' in 65 minutes according to a double jet method.

In addition, during the addition of the Solution III and Solution IV', Solution V was simultanously added thereto in 15 minutes., After completion of the addition, the resulting emulsion was chemically sensitized with a chloroaurate and sodium thiosulfate.

TABLE 3

| | Solution I | Solution II | Solution III | Solution IV' | Solution V |
|---|---|---|---|---|---|
| $AgNO_3$ (g) | 4.5 | — | 95.5 | — | — |
| $H_2O$ (cc) | 17 | 16.7 | 561 | 542 | 100 |
| KBr (g) | — | 3.15 | — | 69.6 | — |
| KI (g) | — | — | — | — | 1.5 |
| 5 wt % aq. soln. of $HO(CH_2)_2S(CH_2)_2S(CH_2)OH$ (cc) | — | 0.45 | — | 9.6 | — |

The tabular silver halide grains thus obtained had a mean diameter of 2.8μ and an average diameter-to-thickness ratio of 13. Then, an antifoggant, a coating aid, and a thickening agent were added to the resulting emulsion similarly with Photographic Material (11) to prepare a coating solution. This solution had a silver-to-gelatin weight ratio of 1.05.

Then, this coating solution and the same coating solution for forming surface-protecting layer as used for Photographic Material (11) were used in the same manner as with Photographic Material (11) and coated to prepare Photographic Material (17). In this occasion, the silver halide emulsion layer was coated in a silver amount of 2.8 g/m$^2$, and the surface-protecting layer in a gelatin amount of 1.3 g/m$^2$.

Photographic Materials (18) to (22) were prepared by adding Compounds I-7, I-10, I-11, I-6 and II-1 shown in Table 4, respectively, to the silver halide emulsion for preparing the Photographic Material (17).

Each of the thus-prepared Photographic Materials (11) to (22) was exposed using Hi Standard screen (made by Fuji Photo Film Co., Ltd., using calcium tungstate), then subjected to the following Processing A' or B'.

Processing A':

Developing the photographic material at 35° C. for 25 seconds with a developing solution of the following formulation, fixing it at 35° C. for 25 seconds with a fixing solution of the following formulation, then washing and drying it.

Developing solution A'

-continued

| | |
|---|---|
| 1-Phenyl-3-pyrazolidone | 1.5 g |
| Hydroquinone | 30 g |
| 5-Nitroindazole | 0.25 g |
| KBr | 3.7 g |
| Anhydrous sodium sulfite | 50 g |
| Potassium hydroxide | 20 g |
| Boric acid | 10 g |
| 25% Glutaraldehyde aq. soln. | 20 ml |
| Water to make | 1 liter |
| (pH: adjusted to 10.20) | |
| Fixing solution | |
| Ammonium thiosulfate | 200.0 g |
| Sodium sulfite (anhydrous) | 20.0 g |
| Boric acid | 8.0 g |
| Disodium ethylenediaminetetraacetate | 0.1 g |
| Aluminum sulfate | 15.0 g |
| Sulfuric acid | 2.0 g |
| Glacial acetic acid | 22.0 g |
| Water to make | 1.0 liter |
| (pH: adjusted to 4.20) | |

Processing B':

The same as the above-described Processing A' except for additionally adding 11.4 g/liter of KBr to the above-described developing solution A'.

The sensitivity of each of the thus-processed photographic materials was measured to obtain the results given in Table 4. In Table 4, sensitivity was presented as a logarithm of a reciprocal of an exposure amount necessary for attaining an effective density of 1.0 excluding fog.

TABLE 4

| Photographic Material | Compound Added | Amount Added (mmol/mol-Ag) | Sensitivity Difference based on (11) processed by Processing A' (Δlog E) | Sensitivity Difference Between Processing A' and Processing B'/Sensitivity Difference Between Processing A' and Processing B' with (11) |
|---|---|---|---|---|
| (11) | none | — | 0 | 1.0 |
| (12) | I-7 | 0.4 | −0.14 | 0.53 |
| (13) | I-10 | 0.2 | −0.35 | 0.48 |
| (14) | I-11 | 0.4 | −0.22 | 0.60 |
| (15) | I-6 | 0.2 | −0.24 | 0.50 |
| (16) | II-1 | 0.33 | −0.21 | 0.62 |

| Photographic Material | Compound Added | Amount Added (mmol/mol-Ag) | Sensitivity Difference based on (21) processed by Processing A' (Δlog E) | Sensitivity Difference Between Processing A' and Processing B'/Sensitivity Difference Between Processing A' and Processing B' with (21) |
|---|---|---|---|---|
| (17) | none | — | 0 | 1.0 |
| (18) | I-7 | 0.4 | +0.01 | 0.18 |
| (19) | I-10 | 0.2 | −0.05 | 0.18 |
| (20) | I-11 | 0.4 | 0 | 0.27 |
| (21) | I-6 | 0.2 | −0.01 | 0.18 |
| (22) | II-1 | 0.33 | +0.03 | 0.36 |

As is clear from the results given in Table 2, the combination of the tabular grains-containing emulsion and the compound of the present invention (see, Table 4 (B)) can remarkably reduce dependence of sensitivity on KBr concentration of the processing solution as compared with the case of adding the compound of the present invention to an ordinary emulsion (containing spherical grains) (see, Table 4 (A)). In addition, with the comparative ordinary emulsion (see, Table 4 (A)), serious desensitization took place, though dependence of sensitivity on KBr concentration was reduced to some extent, whereas the tabular grains-containing emulsion (see, Table 4 (B)) underwent almost no fluctuation in sensitivity.

EXAMPLE 3

On both sides of a subbed, 180 μm thick polyethylene terephthalate were coated the same tabular silver halide grains-containing emulsion layer as used in Photographic Material (17) in Example 2 (for U layer), the same spherical silver halide-containing emulsion as used in Photographic Material (11) in Example 2 (for O layer), and the same coating solution for forming surfaceprotecting layer as used in Example 2 in this order according to a simultaneous extrusion coating method, and dried to prepare X-ray Photographic Material (23). Additionally, the coating solution for forming surface-protecting layer further contained polyethylene oxide, $C_{16}H_{33}O—(CH_2CH_2O)_{10}—H$. The resulting X-ray photographic material contained 2.0 g/m$^2$ of silver in the O layer and 1.4 g/m$^2$ of silver in the U layer. In addition, the surface-protecting layer contained 1.3 g/m$^2$ of gelatin and had a thickness of 1.0μ.

Photographic Materials (24) to (28) of stratum structure were prepared in the same manner as with Photographic Material (23) using tabular silver halide grains-containing emulsions containing the compounds of the present invention as shown in Table 5 like Photographic Materials (18) to (22) in Example 2.

Each of the thus prepared Photographic Materials (23) to (28) was exposed to X-rays using Hi Standard screen (made by Fuji Photo Film Co., Ltd.; using calcium tungstate), then subjected to the following processings.

Processing A':

The same as in Example 2.

Processing B':

The same as in Example 2.

Processing C:

The same as processing A' except for changing the developing temperature to 31° C.

Processing D:

The same as processing A' except for changing the developing temperature to 38° C.

Sensitivity of each processed photographic material was measured to obtain the results shown in Table 5. In Table 5, sensitivity was presented as a logarithm of a reciprocal of an exposure amount necessary for attaining an effective density of 1.0 excluding fog.

As is clear from Table 5, addition of the compounds of the present invention can remarkably reduce dependence of sensitivity on KBr concentration and on processing temperature.

TABLE 5

| Photographic Material | Compound Added to Layer U | Added Amount (mmol/mol-Ag) | Sensitivity Difference Between Processing A' and B' (Δlog E) | Sensitivity Difference Between Processing C and D (Δlog E) |
|---|---|---|---|---|
| (23) | none | — | −0.35 | −0.55 |
| (24) | I-7 | 0.4 | −0.03 | −0.35 |
| (25) | I-10 | 0.2 | −0.04 | −0.34 |

TABLE 5-continued

| Photographic Material | Compound Added to Layer U | Added Amount (mmol/mol-Ag) | Sensitivity Difference Between Processing A' and B' (Δlog E) | Sensitivity Difference Between Processing C and D (Δlog E) |
|---|---|---|---|---|
| (26) | I-11 | 0.4 | −0.03 | −0.33 |
| (27) | I-6 | 0.2 | −0.03 | −0.44 |
| (28) | II-1 | 0.33 | −0.09 | −0.30 |

EXAMPLE 4

Photographic Materials (41) to (52) were prepared in the same manner as Example 1 except that the amount of KI used in the solution V for preparing the tabular silver halide grains was changed from 1.5 g to 3.0 g and that compounds shown in Table 5 below were used. The results are shown in Table 5.

TABLE 5

| Photographic Material | Compound Added | Amount Added (mmol/mol-Ag) | Sensitivity Difference based on Photographic Material (41) processed by Processing A (Δlog E) | Sensitivity Difference Between Processing A and Processing B (Δlog E) |
|---|---|---|---|---|
| (41) | none | — | 0 (control) | 0.19 |
| (42) | Compound I-6* | 0.4 | −0.02 | 0.05 |
| (43) | Compound I-7* | " | 0 | 0.05 |
| (44) | Compound II-1* | " | −0.02 | 0 |
| (45) | Comparative Compound c | " | −0.07 | 0.09 |
| (46) | Comparative Compound d | " | −0.10 | 0.13 |
| (47) | Comparative Compound e | " | −0.05 | 0.10 |
| (48) | Comparative Compound f | " | −0.31 | 0.09 |
| (49) | Comparative Compound g | " | −0.04 | 0.12 |
| (50) | Comparative Compound h | " | −0.46 | 0.05 |
| (51) | Comparative Compound i | " | −0.06 | 0.10 |
| (52) | Comparative Compound j | " | −0.03 | 0.11 |

*Invention

Comparative Compound c: (compound 1 in Table III of U.S. Pat. No. 4,439,520, described at column 32 line 20 thereof)

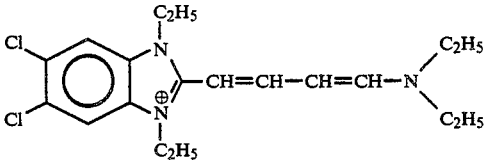

Comparative Compound d: (compound 1 in Table V of U.S. Pat. No. 4,439,520, described at column 34 line 5 thereof)

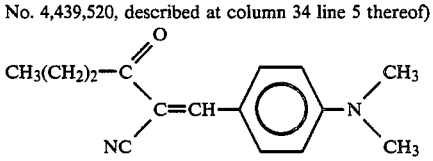

Comparative Compound e: (compound 5 in Table II of U.S. Pat. No. 4,439,520, described at column 31 line 45 thereof)

TABLE 5-continued

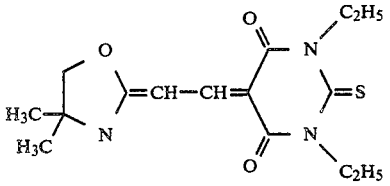

Comparative Compound f: (compound 4 in Table II of U.S. Pat. No. 4,439,520, described at column 31 line 35 thereof)

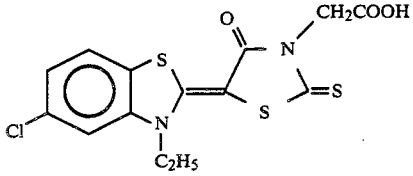

Comparative Compound g: (being within the scope of U.S. Pat. No. 4,439,520)

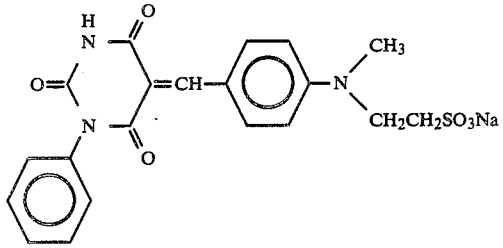

Comparative Compound h: (being within the scope of U.S. Pat. No. 4,439,520)

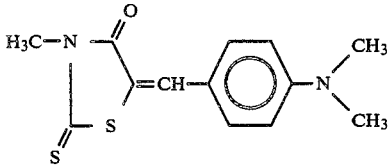

Comparative Compound i: (being within the scope of U.S. Pat. No. 4,439,520)

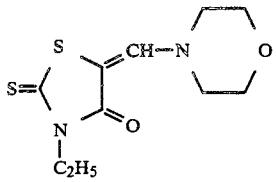

Comparative Compound j: (being within the scope of U.S. Pat. No. 4,439,520)

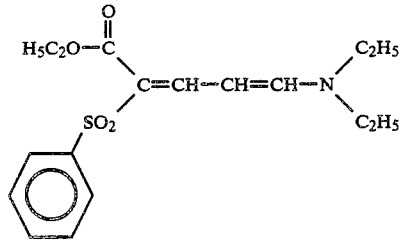

As is clear from the results given in Table 5, addition of the compound of the present invention (Photographic Materials (42), (43) and (44)) served to remarkably reduce dependency of sensitivity on KBr concentration (i.e., very small sensitivity difference between Processing A and Processing B) and, the desensitization scarcely took place (i.e., none or very small sensitivity difference based on Photographic Material (41) by Processing A).

On the other hand, addition of the comparative compound which are the compound being practically described at or within the scope of columns 24–34 of U.S. Pat. No. 4,439,520, does not satisfy both the dependence of photographic properties on development processing condition and the prevention of desensitization at once.

EXAMPLE 5

X-ray Photographic Materials (61) to (71) were prepared in the same manner as Example 1 except for using the compounds shown in Table 6 below in place of the compounds shown in Table 2 of Example 1. The Photographic Materials (61) to (71) were subjected to the same processing as Processing A in Example 1 except that water washing was carried out at 20° C. for 30 seconds.

The results are shown in Table 6 below. In Table 6, degree of stain was evaluated in the following 5 stages;

5 . . . no stain,
4 . . . slight stain was observed,
3 . . . small stain was observed (but within practically usable range),
2 . . . stain was observed, and
1 . . . remarkable stain was observed.

TABLE 6

| Photographic Material | Compound Added | Amount Added (mmol/mol-Ag) | Stain | Remarks |
|---|---|---|---|---|
| (61) | none | — | 5 | Control |
| (62) | k* | 0.1 | 4 | Comparison |
| (63) | " | 0.2 | 3 | " |
| (64) | " | 0.3 | 2 | " |
| (65) | " | 0.4 | 1 | " |
| (66) | f** | " | 1~2 | " |
| (67) | l*** | " | <1 | " |
| (68) | I-6 | " | 4~5 | Invention |
| (69) | I-7 | " | 3~4 | " |
| (70) | II-1 | " | 3~4 | " |
| (71) | II-4 | " | 3 | " |

*Comparative Compound k:

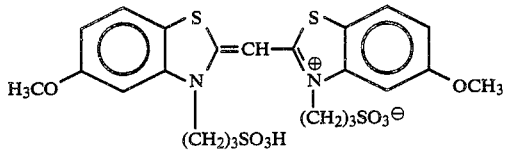

**Comparative Compound f:

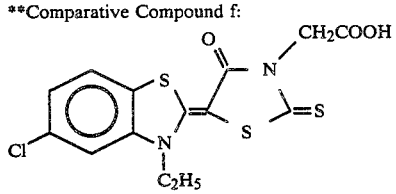

***Comparative Compound l:

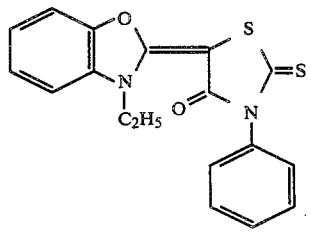

Further, Photographic Materials (61), (62), (63) and (65) were subjected to the same processing as Example 4 to evaluate the dependency of sensitivity on KBr concentration and the desensitization. The results are shown in Table 7 below.

TABLE 7

| Photographic Material | Compound Added | Amount Added (mmol/mol-Ag) | Sensitivity Difference based on Photographic Material (61) processed by Processing A (Δlog E) | Sensitivity Difference Between Processing A and Processing B (Δlog E) |
|---|---|---|---|---|
| (61) | none | — | 0 (control) | 0.19 |
| (62) | k | 0.1 | 0 | 0.15 |
| (63) | " | 0.2 | −0.01 | 0.10 |
| (65) | " | 0.4 | −0.03 | 0.04 |

It is apparent from the results in Tables 6 and 7 that when the comparative compound k was used in an amount of 0.3 or 0.4 mmol/mol-Ag, stain problem occured (see, Photographic Materials (64) and (65) in Table 6). When the comparative compound k was used in an amount of 0.1 or 0.2 mmol/mol-Ag, stain problem did not occured (see, Photographic Materials (62) and (63) in Table 6), but the dependency of sensitivity on KBr concentration occured (see, Photographic Materials (62) and (63) in Table 7).

On the other hand, the compound of the present invention improved the dependency of sensitivity on KBr concentration without stain problem.

EXAMPLE 6

Each X-ray Photographic Materials (61) and (65) to (69) prepared in Example 5 was exposed through a screen, i.e., Hi-Standard Screen (made by Fuji Photo Film Co., Ltd.) or X-Omatic Regular Screen (made by Eastman Kodak Company). The resulting Materials were subjected to the same processing as Processing A in Example 1. Thereby, the dependence of sensitivity on the screen was evaluated by the following formula:

$$\text{Senstivity Ratio} = \frac{\text{Sensitivity obtained by using Hi-Standard Screen}}{\text{Sensitivity Obtained by using X-Omatic Regular Screen}}$$

The sensitivity ratio is a relative value when the sensitivity ratio of Photographic Material (61) is taken as 1.

The results are shown in Table 8 below.

TABLE 8

| Photographic Material | Compound added | Sensitivity Ratio | Remarks |
|---|---|---|---|
| (61) | — | 1 | Control |
| (65) | k | 1.10 | Comparison |
| (66) | f | 1.12 | " |
| (67) | 1 | 1.15 | " |
| (68) | I-6 | 1.02 | Invention |
| (69) | I-7 | 1.05 | " |

It is apparent from the above that addition of comparative compounds scarcely served to reduce dependence of sensitivity on screen used, that is, sensitivity obtained by using Hi-Standard Screen was good but the sensitivity obtained by using X-Omatic Regular Screen was relatively decreased. Thus, the comparative compounds are not practically preferred.

On the other hand, addition of the compound of the present invention served to reduce dependence of sensitivity on screen, which is practically very advantageous.

While the invention has been described in detail and with reference to specific embodiment thereof, it will be apparent to one skilled in the art that various changes and modifications can be made therein without departing from the spirit and scope thereof.

What is claimed is:

1. A silver halide photographic light-sensitive material, comprising;

a support base having provided thereon;

a hydrophilic colloid layer; and a silver halide emulsion layer containing tabular silver halide grains having a diameter at least three times their thickness and a compound represented by a general formula selected from the group consisting of (I) and (II).

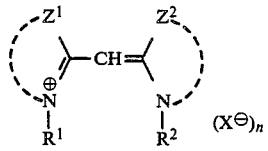

(I)

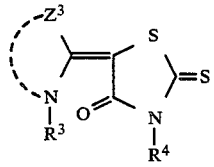

(II)

wherein $Z^1$ represents atoms necessary to complete an oxazole, a benzoxazole or a naphthoxazole, $Z^2$ represents atoms necessary to complete an oxazole, a benzoxazole, a naphthoxazole, a thiazole, a benzothiazole, or a naphthothiazole, $Z^3$ represents atoms necessary to complete an oxazole, a benzoxazole or a naphthoxazole, $R^1$, $R^2$ and $R^3$ each represents an alkyl group or a substituted alkyl group, $R^4$ represents an alkyl group, a substituted alkyl group, an aryl group or a substituted aryl group, X represents an acid anion, n represents 0 or 1, and the compound represented by the general formula (II) contains at least one organic acid-substituted alkyl group.

2. A silver halide photographic light-sensitive material as claimed in claim 1, wherein the alkyl group for $R^1$, $R^2$ and $R^3$ has 1 to 8 carbon atoms.

3. A silver halide photographic light-sensitive material as claimed in claim 1, wherein the substituted alkyl group for $R^1$, $R^2$ and $R^3$ has 1 to 10 carbon atoms.

4. A silver halide photographic light-sensitive material as claimed in claim 1, wherein the alkyl group for $R^4$ has 1 to 8 carbon atoms.

5. A silver halide photographic light-sensitive material as claimed in claim 1, wherein the substituted alkyl group for $R^4$ has 1 to 10 carbon atoms.

6. A silver halide photographic light-sensitive material as claimed in claim 1, wherein the aryl group and the substituted aryl group for $R^4$ have 6 to 10 carbon atoms.

7. A silver halide photographic light-sensitive material as claimed in claim 1, wherein the compound represented by the general formula (I) or (II) is present in an amount in the range of 0.01 to 10 m mols per mol of silver halide in the tabular silver halide grains-containing silver halide emulsion layer.

8. A silver halide photographic light-sensitive material as claimed in claim 7, wherein the compound represented by the general formula (I) or (II) is present in an amount in the range of 0.05 to 1.0 m mol per mol of silver halide in the tabular silver halide grains-containing silver halide emulsion layer.

9. A silver halide photographic light-sensitive material as claimed in claim 1, wherein the tabular silver halide grains have a diameter-to-thickness ratio of 5 or more.

10. A silver halide photogrpahic light-sensitive material as claimed in claim 9, wherein the tabular silver halide grains have a diameter-to-thickness ratio in the range of 5 to 50.

11. A silver halide photographic light-sensitive material as claimed in claim 10, wherein the tabular silver halide grains have a diameter-to-thickness ratio in the range of 7 to 20.

12. A silver halide photographic light-sensitive material as claimed in claim 1, wherein the tabular silver halide grains have a diameter in the range of 0.5 to 5.0μ.

13. A silver halide photographic light-sensitive material as claimed in claim 12, wherein the tabular silver halide grains have a diameter in the range of 1.0 to 4.0μ.

14. A silver halide photographic light-sensitive material as claimed in claim 1, wherein the tabular silver halide grains are present in an amount of 40% by weight based on the weight of the whole silver halide of the tabular silver halide grains-containing silver halide emulsion layer.

15. A silver halide photographic light-sensitive material as claimed in claim 14, wherein the tabular silver halide grains are present in an amount of 60% by weight or more based on the weight of the whole silver halide of the tabular silver halide grains-containing silver halide emulsion layer.

16. A silver halide photographic light-sensitive material as claimed in claim 1, wherein the silver halide emulsion layer containing tabular silver halide grains has a thickness in the range of 0.3 to 5.0μ.

17. A silver halide photographic light-sensitive material as claimed in claim 16, wherein the silver halide emulsion layer containing tabular silver halide grains has a thickness in the range of 0.5 to 3.0μ.

18. A silver halide photographic light-sensitive material as claimed in claim 1, wherein the tabular silver halide grains are present in an amount in the range of 0.5 to 6 $g/m^2$ per one side of a support.

19. A silver halide photographic light-sensitive material as claimed in claim 18, wherein the tabular silver halide grains are present in an amount in the range of 1 to 4 $g/m^2$ per one side of a support.

20. A silver halide photographic light-sensitive material as claimed in claim 1, wherein the material is a color photographic light-sensitive material.

21. A silver halide photographic light-sensitive material as claimed in claim 1, wherein the material is a balck-and-white photographic light-sensitive material.

22. A silver halide photographic light-sensitive material as claimed in claim 21, wherein the material is an X-ray light-sensitive material.

23. A silver halide photographic light-sensitive mateiral as claimed in claim 1, wherein $Z_1$ represents atoms necessary to complete a benzoxazole and $Z^2$represents atoms necessary to complete a benzoxazole or a benzothiazole.

24. A silver halide photographic light-sensitive material as claimed in claim 23, wherein the benzoxazole and the benzothiazole completed by $Z^1$ or $Z^2$ are substituted with a phenyl group or a chlorine atom.

25. A silver halide photographic light-sensitive material as claimed in claim 24, wherein the benzoxazole and the benzothiazole completed by $Z^1$ or $Z^2$ are substituted with a phenyl group.

26. A silver halide photographic light-sensitive material as claimed in claim 1, wherein $R^1$ and/or $R^2$ represents an alkyl group substituted with an organic acid group.

27. A silver halide photographic light-sensitive material as claimed in claim 27, wherein $R^1$ and $R^2$ represent an alkyl group substituted with an organic acid group.

28. A silver halide photographic light-sensitive material as claimed in claim 1, wherein $R^3$ and/or $R^4$ represents an alkyl group substituted with an organic acid group.

29. A silver halide photographic light-sensitive material as claimed in claim 1, wherein $Z^3$ represents atoms necessary to complete a benzoxazole.

30. A silver halide photographic light-sensitive material as claimed in claim 29, wherein the benzoxazole completed by $Z^3$ is substituted with a phenyl group or a chlorine atom.

31. A silver halide photographic light-sensitive material as claimed in claim 30, wherein the benzoxazole completed by $Z^3$ is substituted with a phenyl group.

32. A silver halide photographic light-sensitive material as claimed in claim 1, wherein the silver halide photographic light-sensitive material exhibits reduced stain after photographic development.

* * * * *